US008109212B2

(12) United States Patent
O'Dwyer

(10) Patent No.: US 8,109,212 B2
(45) Date of Patent: Feb. 7, 2012

(54) SLEEVED PROJECTILES

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 12/623,289

(22) Filed: Nov. 20, 2009

(65) Prior Publication Data

US 2010/0126370 A1 May 27, 2010

Related U.S. Application Data

(62) Division of application No. 11/387,714, filed on Mar. 24, 2006, now abandoned, which is a division of application No. 10/275,714, filed as application No. PCT/AU01/00556 on May 15, 2001, now Pat. No. 7,210,412.

(30) Foreign Application Priority Data

May 15, 2000 (AU) ..... PQ 7499

(51) Int. Cl.
*F42B 14/06* (2006.01)

(52) U.S. Cl. ..... 102/520; 102/523; 102/438; 102/217

(58) Field of Classification Search ..... 102/520, 102/523, 438, 217
See application file for complete search history.

(56) References Cited

U.S. PATENT DOCUMENTS

| | | | | |
|---|---|---|---|---|
| 58,783 | A | 10/1866 | Currie | |
| 694,896 | A | 3/1902 | Scott | |
| 926,731 | A | 6/1909 | Luger | |
| 2,099,993 | A * | 11/1937 | Tauschek | 89/125 |
| 2,897,757 | A * | 8/1959 | Kulluck | 102/438 |
| 3,139,795 | A | 7/1964 | Altschuler | |
| 3,169,333 | A | 2/1965 | Scanlon, Jr. | |
| 4,800,816 | A | 1/1989 | Meyer | |
| 5,883,329 | A | 3/1999 | O'Dwyer | |
| 6,138,395 | A * | 10/2000 | O'Dwyer | 42/84 |
| 6,305,293 | B1 | 10/2001 | Fry et al. | |
| 6,343,553 | B1 * | 2/2002 | O'Dwyer | 102/438 |

(Continued)

FOREIGN PATENT DOCUMENTS

| | | |
|---|---|---|
| DE | 17171 | 8/1881 |
| DE | 647135 | 9/1934 |
| GB | 2161908 A | 1/1986 |
| WO | WO 97/04281 | 2/1997 |
| WO | WO 98/55824 | 12/1998 |
| WO | WO 98/55825 | 12/1998 |
| WO | WO 00/62005 | 10/2000 |

*Primary Examiner* — Michelle Clement

(74) *Attorney, Agent, or Firm* — Blakely Sokoloff Taylor & Zafman LLP

(57) ABSTRACT

A projectile (10) is for use with barrel assemblies of the type having a plurality of projectiles axially disposed within a barrel having a bore and a muzzle and which projectiles are associated with discrete propellant charges for propelling said projectiles sequentially through the muzzle of the barrel. Projectile (10) comprises expandable sleeve (11) encircling at least part of core (12). Sleeve (11) and core (12) have wedging surfaces (14) operable to deform trailing part (21) of sleeve (11) into sealing engagement with the bore in response to pressure exerted on the projectile (10). When projectiles (10) are axially disposed in the bore, rear face (24) of the leading projectile cooperates with leading face (20) of the trailing projectile to define a discrete space about spine (23) for receipt of the propellant charge. Sleeve (11) is retained about the core (12) during travel to the target.

20 Claims, 10 Drawing Sheets

U.S. PATENT DOCUMENTS 6,431,076 B1 * 8/2002 O'Dwyer ..... 102/525
6,715,398 B2 * 4/2004 O'Dwyer ..... 89/135
6,722,252 B1 * 4/2004 O'Dwyer ..... 89/1.41
6,782,826 B1 * 8/2004 O'Dwyer ..... 102/341
7,140,301 B1 * 11/2006 O'Dwyer ..... 102/361
2004/0231219 A1 * 11/2004 O'Dwyer ..... 42/84
2009/0241796 A1 * 10/2009 Bambach ..... 102/438
2010/0101443 A1 * 4/2010 Rosales et al. ..... 102/438

* cited by examiner

SLEEVED PROJECTILES

RELATED APPLICATIONS

This application is a divisional application of co-pending U.S. patent application Ser. No. 11/387,714, filed Mar. 24, 2006, which is a divisional application of U.S. patent application Ser. No. 10/275,714, filed Nov. 8, 2002, now U.S. Pat. No. 7,210,412, which is a national phase application based on International Application No. PCT/USAU01/00556, filed May 15, 2001, which claims the priority of Australian Patent Application No. PQ 7499, filed May 15, 2000. The disclosure of the above-identified applications is incorporated by reference herein in its entirety.

FIELD OF THE INVENTION

The present invention relates to projectiles for use with barrel assemblies having a plurality of projectiles axially disposed within the barrel and which projectiles are associated with discrete propellant charges for propelling the projectiles sequentially through the muzzle of the barrel.

BACKGROUND

Our earlier patent applications relate to small arms, mortars and large bore rounds and the like and this invention relates to rounds for such weapons.

Trials of a handgun according to aspects of our earlier patent applications have indicated that the two-part small caliber projectiles have a tendency to separate in flight especially when they tumble. In one aspect this invention aims to provide a suitable projectile assembly in which the parts remain intact as a streamlined projectile during passage to a target.

SUMMARY OF THE DESCRIPTION

A projectile (10) is for use with barrel assemblies of the type having a plurality of projectiles axially disposed within a barrel having a bore and a muzzle and which projectiles are associated with discrete propellant charges for propelling said projectiles sequentially through the muzzle of the barrel. Projectile (10) comprises expandable sleeve (11) encircling at least part of core (12). Sleeve (11) and core (12) have wedging surfaces (14) operable to deform trailing part (21) of sleeve (11) into sealing engagement with the bore in response to pressure exerted on the projectile (10). When projectiles (10) are axially disposed in the bore, rear face (24) of the leading projectile cooperates with leading face (20) of the trailing projectile to define a discrete space about spine (23) for receipt of the propellant charge. Sleeve (11) is retained about the core (12) during travel to the target.

BRIEF DESCRIPTION OF THE DRAWINGS

In order that this invention may be more readily understood and put into practical effect reference will now be made to the accompanying drawings which illustrate a preferred embodiment of the invention wherein.

DETAILED DESCRIPTION

Figure 1:
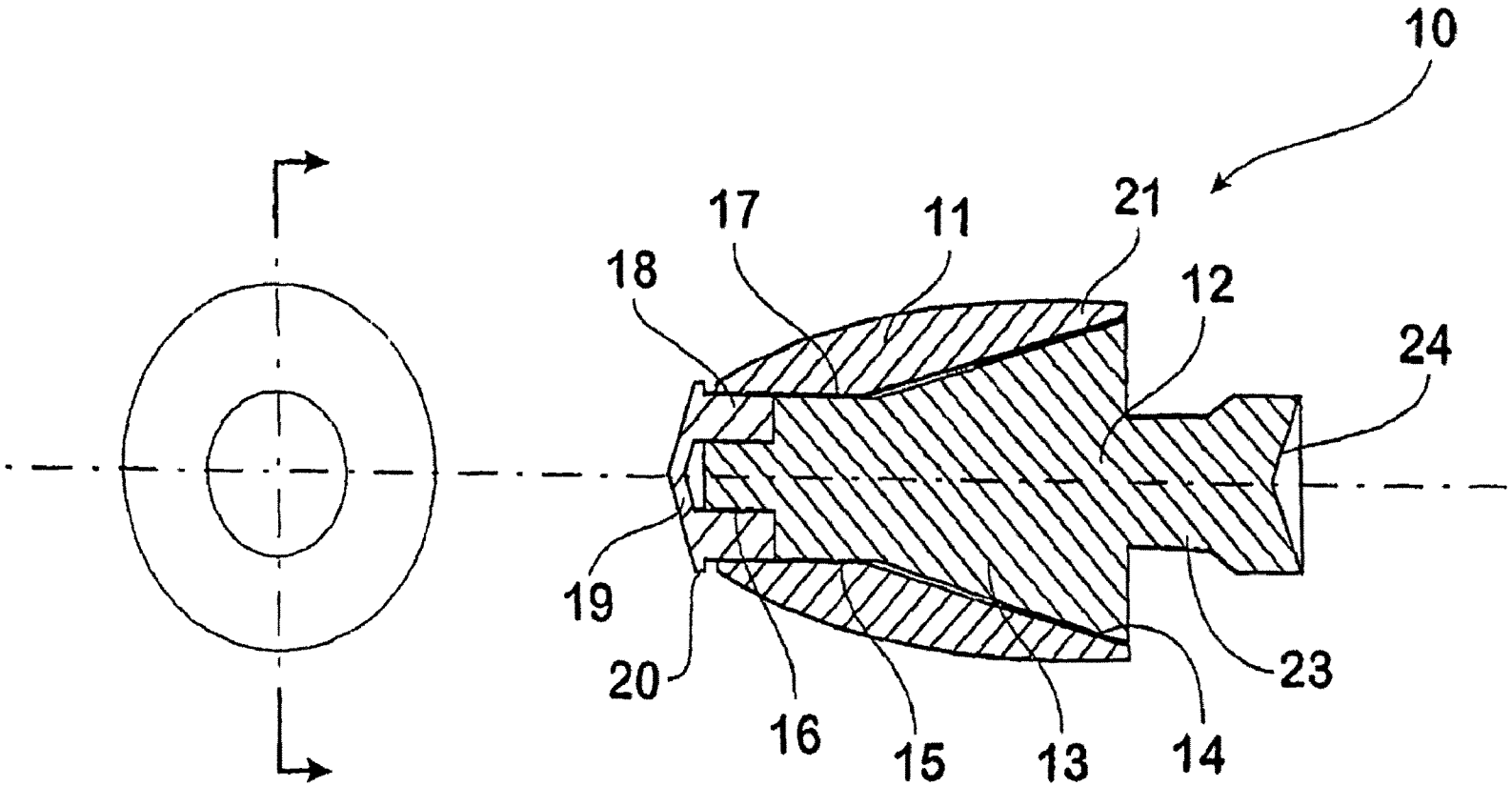
FIGS. 1 to 3 each illustrates a 9 mm projectile assembly suitable for use with a hand gun.

We have now found a projectile for use with barrel assemblies of the type having a plurality of projectiles axially disposed within a barrel having a bore and a muzzle and which projectiles are associated with discrete propellant charges for propelling said projectiles sequentially through the muzzle of the barrel, said projectiles comprising an expandable sleeve for engagement with the bore of the barrel and a projectile core about which said sleeve is disposed, wherein said expandable sleeve and said projectile core have cooperating surfaces operable to deform said expandable sleeve into sealing engagement with the bore of the barrel in response to pressure exerted upon a leading face of the projectile, and wherein a rear working surface of a leading projectile and said leading face of a trailing projectile are associated with a spacer permitting projectiles to be axially disposed within said barrel to define a propellant space between said leading projectile and said trailing projectile and wherein said sleeve is retained about said projectile core during travel to the target.

In a first preferred embodiment of the present invention the spacer may be integrally formed with the projectile core. In this embodiment the projectile core may take the form of a spine that extends axially through the barrel in abutment for maintaining said propellant space. In this first embodiment the present invention provides a projectile for use with barrel assemblies of the type having a plurality of projectiles axially disposed within a barrel having a bore and a muzzle and which projectiles are associated with discrete propellant charges for propelling said projectiles sequentially through the muzzle of the barrel, said projectiles comprising an expandable sleeve for engagement with the bore of the barrel and a projectile core about which said sleeve is disposed, wherein said expandable sleeve and said projectile core have cooperating surfaces operable to deform said expandable sleeve into sealing engagement with the bore of the barrel in response to pressure exerted upon a leading face of the projectile wherein said projectile core comprises a sub-caliber spacer extending rearward from the body part to abut the leading face of a trailing projectile permitting projectiles to be axially disposed within said barrel to define a propellant space between said leading projectile and said trailing projectile and wherein said sleeve is retained about said projectile core during travel to the target.

In a second preferred embodiment of the present invention the spacer may be separate from the projectile. In this embodiment the spacer may take the form of a propellant tube that extends axially through the barrel in abutment with adjacent projectiles and which tube maintains said propellant space within the walls of the tube. In this second embodiment the present invention provides a projectile for use with barrel assemblies of the type having a plurality of projectiles axially disposed within a barrel having a bore and a muzzle and which projectiles are associated with discrete propellant charges for propelling said projectiles sequentially through the muzzle of the barrel, said projectiles comprising an expandable sleeve for engagement with the bore of the barrel and a projectile core about which said sleeve is disposed, wherein said expandable sleeve and said projectile core have cooperating surfaces operable to deform said expandable sleeve into sealing engagement with the bore of the barrel in response to pressure exerted upon a leading face of the projectile, and wherein a rear working surface of a leading projectile and said leading face of a trailing projectile are in abutment with a spacer tube permitting projectiles to be axially disposed within said barrel to define a propellant space between said leading projectile and said trailing projectile and wherein said sleeve is retained about said projectile core during travel to the target.

The present invention has particular application to barrel assemblies of the type described in International Patent Application Nos. PCT/AU94/00124 and PCT/AU96/00459. Such barrel assemblies include a barrel; a plurality of projectiles axially disposed within the barrel for operative sealing engagement with the bore of the barrel, and discrete propellant charges for propelling respective projectiles sequentially through the muzzle of the barrel.

The overall shape of the projectile, including the projectile core and the expandable sleeve may be conventionally shaped dart-like, generally spherical or any other convenient shape. The projectile may also include fins that may advantageously be offset to generate a stabilizing spin as the dart is propelled from a barrel that may be a smooth-bored barrel.

The projectile charge is located in the propellant space and may be formed as a solid block to assist in loading the barrel assemblies. Alternatively the propellant charge may be encased and may include an embedded primer having external contact means adapted for contacting a pre-positioned electrical contact associated with the barrel. For example the primer could be provided with a sprung contact which may be retracted to enable insertion of the cased charge into the barrel and to spring out into a barrel aperture upon alignment with that aperture for operative contact with its mating barrel contact. If desired the outer case may be consumable or may chemically assist the propellant bum. Furthermore an assembly of stacked and bonded or separate cased charges and projectiles may be provided to facilitate the reloading of a barrel.

The barrel may be non-metallic and the bore of the barrel may include recesses that may fully or partly accommodate the ignition means. In this configuration the barrel may house electrical conductors which facilitate electrical communication between the control means and ignition means. This configuration may be utilized for disposable barrel assemblies that have a limited firing life and the ignition means and control wire or wires therefore can be integrally manufactured with the barrel.

A barrel assembly may alternatively include ignition apertures in the barrel and the ignition means are disposed outside the barrel and adjacent the apertures. The barrel may be surrounded by a non-metallic outer barrel which may include recesses adapted to accommodate the ignition means. The outer barrel may also house electrical conductors which facilitate electrical communication between the control means and ignition means. The outer barrel may be formed as a laminated plastics barrel which may include a printed circuit laminate for the ignition means.

The electrical ignition for sequentially igniting the propellant charges of a barrel assembly may preferably include the steps of igniting the leading propellant charge by sending an ignition signal through the stacked projectiles, and causing ignition of the leading propellant charge to arm the next propellant charge for actuation by the next ignition signal. Suitably all propellant charges inwardly from the end of a loaded barrel are disarmed by the insertion of respective insulating ruses disposed between normally closed electrical contacts.

Ignition of the propellant may be achieved electrically or ignition may utilize conventional firing pin type methods such as by using a centre-fire primer igniting the outermost projectile and controlled consequent ignition causing sequential ignition of the propellant charge of subsequent rounds. This may be achieved by controlled rearward leakage of combustion gases or controlled burning of fuse columns extending through the projectiles or the barrel.

In another form the ignition is electronically controlled with respective propellant charges being associated with primers which are triggered by distinctive ignition signals. For example the primers in the stacked propellant charges may be sequenced for increasing pulse width ignition requirements whereby electronic controls may selectively send ignition pulses of increasing pulse widths to ignite the propellant charges sequentially in a selected time order. Preferably however the propellant charges are ignited by a set pulse width signal and burning of the leading propellant charge arms the next propellant charge for actuation by the next emitted pulse.

Suitably in such embodiments all propellant charges inwardly from the end of a loaded barrel are disarmed by the insertion of respective insulating fuses disposed between insertion of respective insulating fuses disposed between normally closed electrical contacts, the fuses being set to burn to enable the contacts to close upon transmission of a suitable triggering signal and each insulating fuse being open to a respective leading propellant charge for ignition thereby.

A number of projectiles can be fired simultaneously, or in quick succession, or in response to repetitive manual actuation of a trigger, for example. In such arrangements the electrical signal may be carried externally of the barrel or it may be carried through the superimposed projectiles which may clip on to one another to continue the electrical circuit through the barrel, or abut in electrical contact with one another. The projectiles may carry the control circuit or they may form a circuit with the barrel.

The projectile of the present invention comprises an expandable sleeve for engagement with the bore of the barrel and a projectile core about which said sleeve is disposed. The expandable sleeve and projectile core have cooperating surfaces operable to deform said expandable sleeve into sealing engagement with the bore of the barrel in response to pressure exerted upon a leading face of the projectile. In one preferred form the cooperating surfaces may be complementary wedging surfaces. Where pressure, such as during loading or tamping of the projectiles into the barrel assembly or when a propellant charge is detonated in advance of the projectile, is exerted on the leading face of the projectile the cooperating surfaces deform the expandable sleeve into sealing engagement with the bore of the barrel.

The projectile core may comprise a relatively hard mandrel portion which cooperates with a deformable annular sleeve that may be molded about the mandrel to form a unitary projectile which relies on material deformation of the sleeve for outward expansion about the mandrel portion into sealing engagement with the bore of the barrel.

In one form the projectile core may include a forwardly tapering wedging surface and the expandable sleeve includes a complimentary surface that causes the sleeve to expand as the sleeve moves rearward relative to the core. The sleeve suitably includes a skirt portion that expands outwardly when subject to an in barrel load. The sealing may be affected by inserting the projectiles into a heated barrel that shrinks onto respective sealing portions of the projectiles.

Alternatively the projectile core may include a rearwardly tapering wedging surface and the expandable sleeve includes a complimentary surface that causes the sleeve to expand as the core moves rearward relative to the sleeve.

Preferably the sleeve engages with a leading or trailing portion of the core to deform into operative sealing engagement with said bore. However sleeve could expand about an intermediate portion of the body into operative sealing engagement with said bore if desired.

The sleeve is retained about said projectile core during travel to the target. The sleeve may be retained about the core by at least one shoulder located on either or both of the sleeve and core. In one form the shoulder may be engaged with a recess on the other component. Alternatively the at least one shoulder may engage at least one end of the other component. The shoulder engages the other component in a manner that permits limited relative movement such that the sleeve can sealably and releasably engage the bore. In one form the sleeve may include an inwardly disposed shoulder for engagement with a recess in the core. Alternatively the core may include an outwardly disposed shoulder for engagement with a corresponding recess in the sleeve.

In another form the sleeve may include a shoulder for engagement with the end of the core having the maximum diameter and wherein the core is tapered and sleeve has a correspondingly tapered surface.

In the first preferred embodiment of the present invention the projectile core incorporates the spacer integrally formed therewith. Suitably the projectile core may be in the form of a spine incorporating a sub-caliber spacer that extends rearwardly from the projectile core. It will be understood that by the term sub-caliber it is meant having a diameter substantially less than that of the bore of the barrel. The propellant space is provided about the spacer.

In one form the projectile cores may be in end-to-end abutment with the rearwardly extending spacer engaging the leading face of the trailing projectile. In this configuration the sleeve may be retained on the core during flight by at least one shoulder on the sleeve and/or the core, which shoulder engages with a complimentary recess in the other component.

The spine may extend into a passage formed through the sleeve and the sleeve may be retained on the spine by means of a cap engageable with the inserted end of the spine so as to prevent withdrawal of the spine part from the sleeve but permitting limited axial movement therebetween for effecting an operative seal between the sleeve and the bore of the barrel. Alternatively the spine may extend into a blind passage formed in the rear end of the sleeve and be retained by means of a collar about the spine and engageable with said rear end so as to prevent withdrawal of the spine from the sleeve but permitting limited axial movement therebetween for effecting an operative seal between the sleeve and the bore of the barrel.

If desired the spine may extend through a passage formed through the sleeve with its leading part splaying or being formed, such as by folding, swaging or peening, so as to extend outwardly beyond the through passage so as to prevent withdrawal of the spine from the sleeve but permitting limited axial movement therebetween for effecting an operative seal between the sleeve and the bore of the barrel.

Similarly the trailing portion of a sleeve formed with a blind passage may incorporate a shoulder or otherwise contract behind or be formed, such as by folding, swaging or peening, so as to extend behind the spine so as to prevent withdrawal of the spine from the sleeve but permitting limited axial movement therebetween for effecting an operative seal between the sleeve and the bore of the barrel.

Suitably a leading part of the core is a frusto-conical portion having a cone angle in the range of 5 degrees to 15 degrees and suitably the trailing end of the frusto-conical head portion terminates in close proximity with the bore so as to expand only a relatively thin trailing portion of the sleeve into operative sealing engagement with the bore.

In the second embodiment of the present invention the spacer is in the form of a spacer tube and may house the propellant charge.

In one form the projectiles are maintained in spaced apart relationship in the barrel by a spacer tube which contains the propellant. The spacer tube is suitably formed as a rigid combustible tube which will combust with the propellant. Alternatively the spacer tube may be formed of non combustible material and be discharged with the projectile and discarded in flight, carried with the projectile or pushed out by a following round.

The spacer may extend through the propellant space and the projectile head whereby compressive loads are transmitted directly through abutting adjacent spacer assemblies. In such configurations, the spacer assembly may add support to the extension means that may be a thin cylindrical rear portion of the projectile head. Furthermore the extension means may form an operative sealing contact with the bore of the barrel to prevent burn leakage past the projectile head.

Complimentary surfaces may also be disposed on the spacer tube and leading face of the projectile respectively whereby the spacer tube is urged into engagement with the bore of the barrel in response to relative axial compression between the spacer tube and the leading face of the projectile. In such arrangement the projectile and spacer tube may be loaded into the barrel and thereafter an axial displacement is caused to ensure good sealing between the spacer tube and barrel.

The spacer assembly may include a rigid collar which extends outwardly to engage a thin cylindrical rear portion of the malleable projectile head inoperative sealing contact with the bore of the barrel such that axially compressive loads are transmitted directly between spacer assemblies thereby avoiding deformation of the malleable projectile head.

In another of the invention the projectiles may be adapted for seating and/or location within circumferential grooves or by annular ribs in the bore or in rifling grooves in the bore and may include a metal jacket encasing at least the outer end portion of the projectile. The projectile may be provided with contractible peripheral locating rings which extend outwardly into annular grooves in the barrel and which retract into the projectile upon firing to permit its free passage through the barrel.

The projectile itself may contain a guidance system and deployable flight means enabling it to be remotely guided to a target.

In a one aspect, this invention generally provides a special purpose round including a sleeve that engages with the bore of the barrel and a projectile core extending centrally through the sleeve wherein the sleeve has a leading end portion forming an annular recess about the leading portion of the core.

The sleeve may be formed as a discarding sabot that can be configured to discard upon impact with a target. In certain applications the sleeve would suitably be formed as a low mass part of a lightweight material such as aluminum, magnesium, manganese or similar metal or of a suitable plastics material, and the core would be formed of a high mass dense material such as lead or a composite of lead. The core may be provided with reinforcing such as steel strakes to provide an effective anvil for expanding the sleeve. Such applications may include armor-piercing applications.

Suitably in such a round the core is in the form of an elongate streamlined body with much of the rearwardly expanding nose portion proud of the surrounding sabotted sleeve so as to facilitate rearward discarding of the sabotted sleeve from the core while preventing forward dislodgment during flight so as to enable the energy imparted to the sabotted sleeve by the propellant to be imparted to the core.

Alternatively the sleeve may be formed so as to have maximum terminal effect upon impact with a target. In such applications the sleeve would suitably be formed as a high mass part of a dense material such lead or a composite or alloy of lead and other material. The core would suitably be formed as a low mass part of a lightweight material such as aluminum, magnesium, manganese or similar metal or of a suitable plastics material. Such rounds are useful in police work, for example, where a suspect may be fired upon in a building occupied by other people. In such circumstances it is desirably that stray shots should not penetrate walls and the like and pose a danger to people in adjacent rooms.

Suitably a majority of the trailing face of the outer part is exposed to the propellant gases. The projectile assembly 10 illustrated in FIG. 1 has an outer body part 11 formed of lead which engages the bore of the barrel in which it is housed and a steel spine part 12 formed with a medially disposed forwardly reducing anvil portion 13 which extends into a complementary passage 14 formed in the body part 11.

The spine part 12 has cylindrical lands 15 and 16 at its leading end. The land 15 engages slidably with a leading cylindrical passage 17 of the outer body part 11 and the land 16 engages captively with a collar 18 of a retaining cap 19, such as by being an interference fit therewith. The cap 19 has a leading end wall 20 which extends outwardly beyond the passage 17 and which is spaced longitudinally from the body part 11 so as to retain the outer body part 11 for limited longitudinal movement along the spine part 12.

As illustrated the taper of the anvil portion 13 is greater than the corresponding taper of the complementary passage 14 so that the trailing end 21 thereof is the first portion to be engaged by the anvil portion 13 whereby in use, rearward movement of the body part 11 along the spine part 12 results in an outward splaying of the trailing part 21 into operative sealing engagement with the bore of the barrel in which it is housed.

Further rearward movement, will cause engagement of the anvil portion with the full surface of the passage 14 providing a progressive increase in resistance to rearward movement of the body part 11 due to a corresponding increase in resistance to radial expansion provided by the body part 11.

Figure 2:
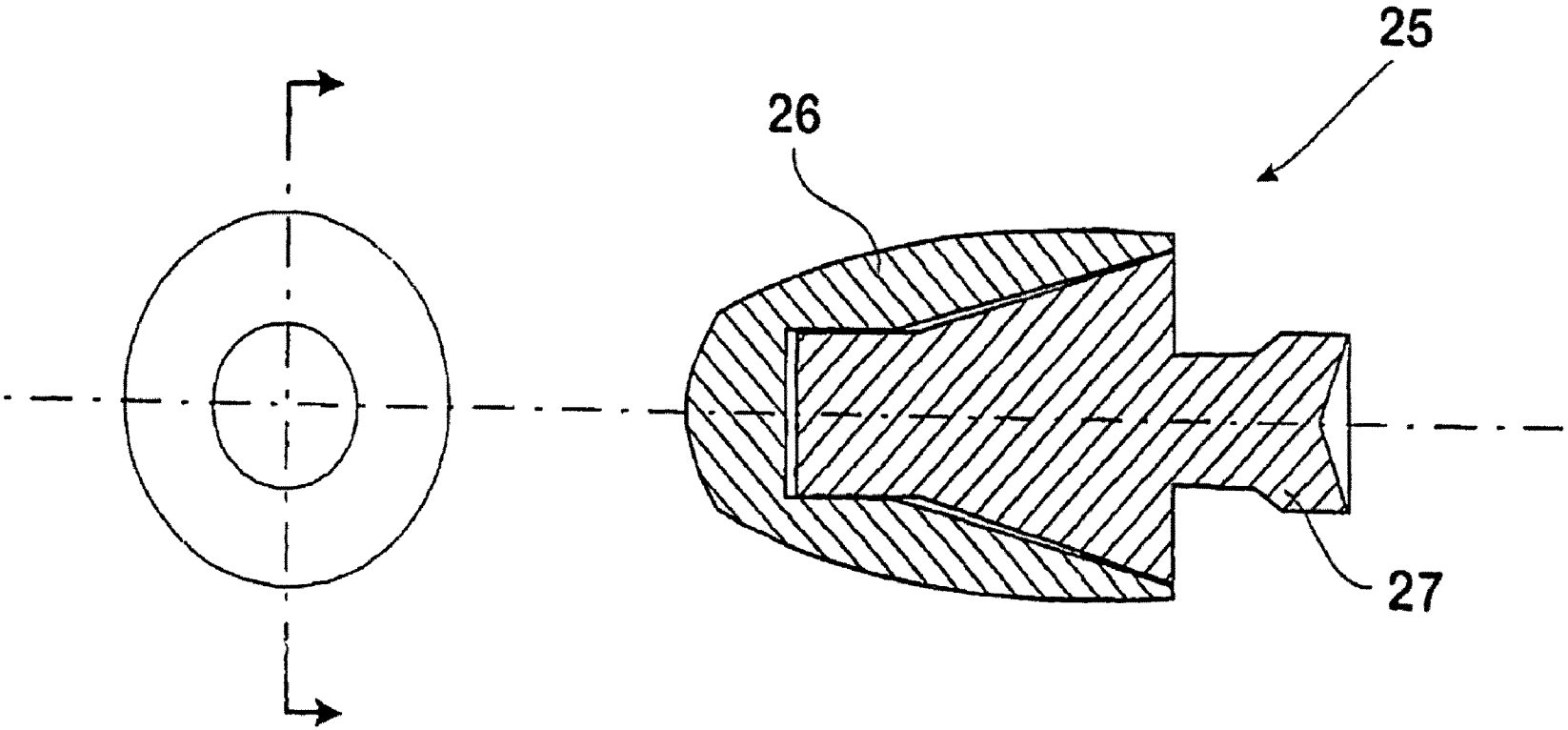

In this embodiment the nose cap 19 is acted upon by pressure from propellant gases from the leading round and thus some of resultant rearward force therefrom is resisted directly by the spine part 12. As a consequence the volume of propellant which may be stored about the rear spine part 23 is less than could be accommodated in a projectile assembly 25 as illustrated in FIG. 2 which has the full front face of the outer part 26 exposed to pressure from propellant gases and being resisted to a large extent by being wedged into sealing engagement with the bore of a barrel in which it is housed. The trailing face 24 of the spine accommodates the cap 19.

The projectile assembly 10 is suited for a revolver or other short range weapon whereas the projectile assembly 25 which may have a reduced diameter or more elongated rear spine part 27 as it copes with less of the reaction force, can be utilized in a longer range weapon.

Figure 3:
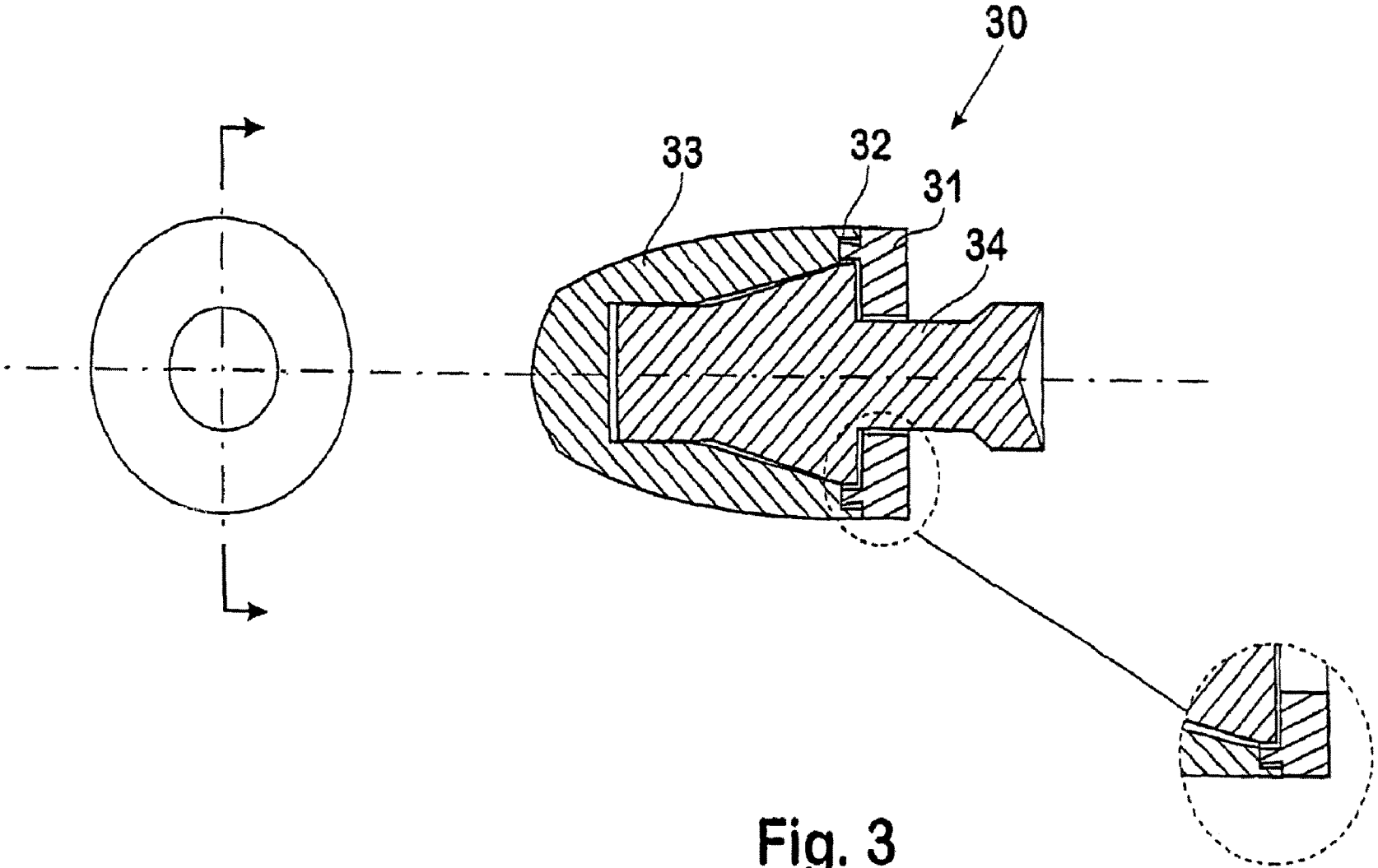

The projectile assembly 30 illustrated in FIG. 3 is similar to the FIG. 2 embodiment. However this projectile assembly 30 has a retaining plate 31 clipped to or retained on the rear end part 32 of the body part 33 so as to prevent in-flight separation of the spine part 34 from the body part 33.

Figure 4:
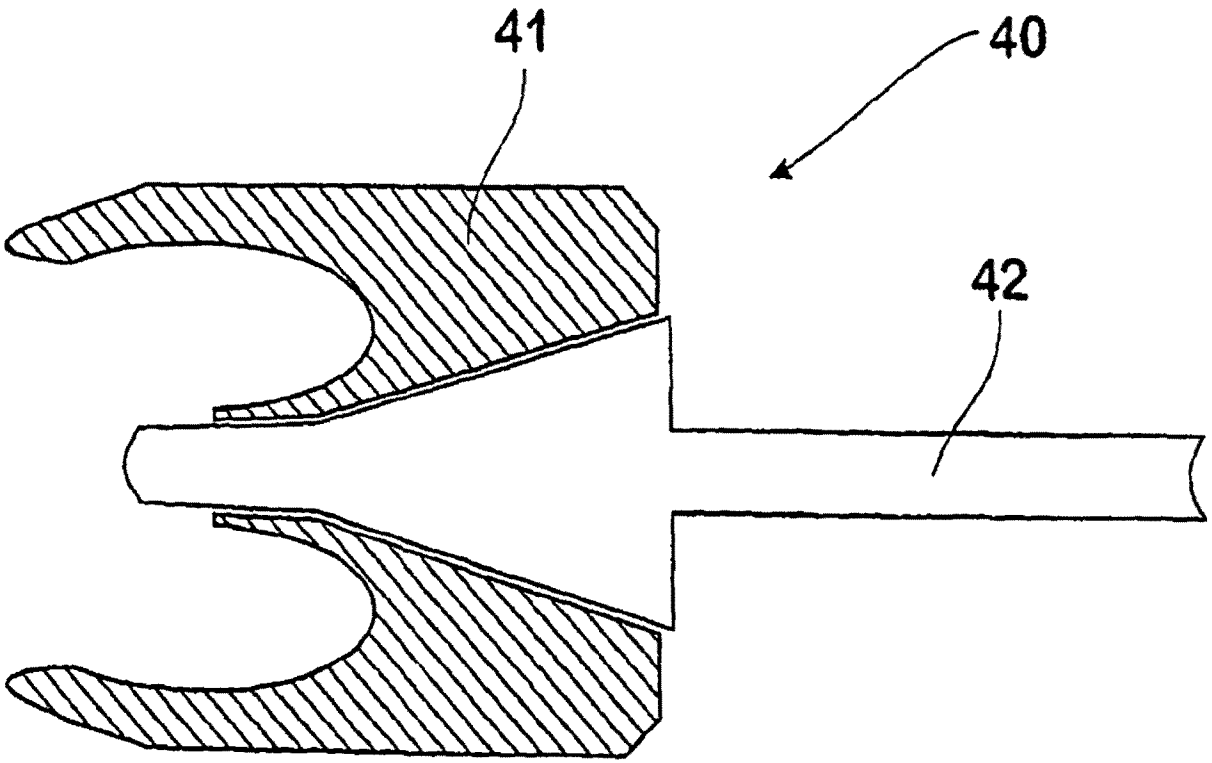
FIG. 4 illustrates a special purpose projectile assembly adapted for target retention.

The projectile assembly 40 illustrated in FIG. 4 is a special purpose round having a body part 41 formed so as to have maximum terminal effect upon impact with a target. The body part 41 engages with the bore of the barrel in which it is supported and its positioning therein is effected by the spine part 42, which as in the embodiments of FIGS. 1 and 5, stacks with complementary spine parts to form a continuous column extending centrally through the barrel with the body parts 41 evenly spaced therealong.

In the illustrated embodiment the body part 41 is formed from lead and the spine part is formed from aluminum.

In use, if such a round is fired from a revolver hits a wall in a dwelling, for example, it will not penetrate the wall. Thus, it can be used by police in close quarters without fear of injuring someone out of the user's sight.

Figure 5:
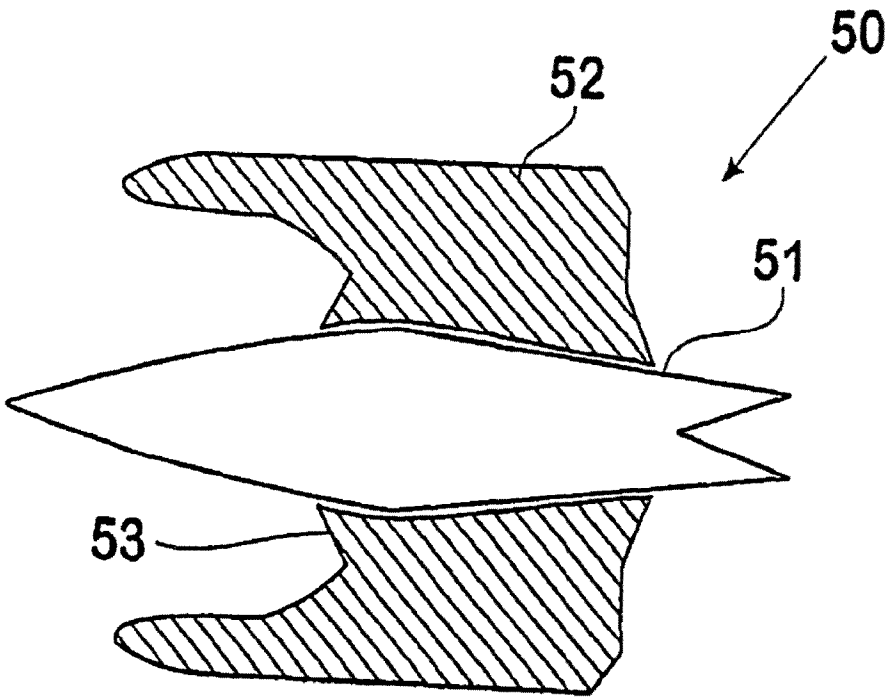
FIG. 5 illustrates yet another special purpose projectile assembly adapted for penetrating a target.

The projectile assembly 50 illustrated in FIG. 5 has a spine part 51 in the form of an elongate streamlined penetrating body formed of lead which is assisted by a lightweight body part 52 forming a sabot which discards in flight. For this purpose the front end of the body part is cupped to provide resistance to high speed flight and its inner portion 53 extends only slightly forward of the major diameter of the spine part 51 so that it can readily slide backwards away from the spine part 51 and discard.

In this arrangement most of the propellant gases act upon the rear face of the sabot 52 and impart more energy to the spine part than could otherwise be imparted thereto. Thus the projectile 50 will exit the muzzle of its supporting barrel at high speed whereupon the sabot will discard leaving the heavy energy boosted spine part traveling to a target.

Figure 6:
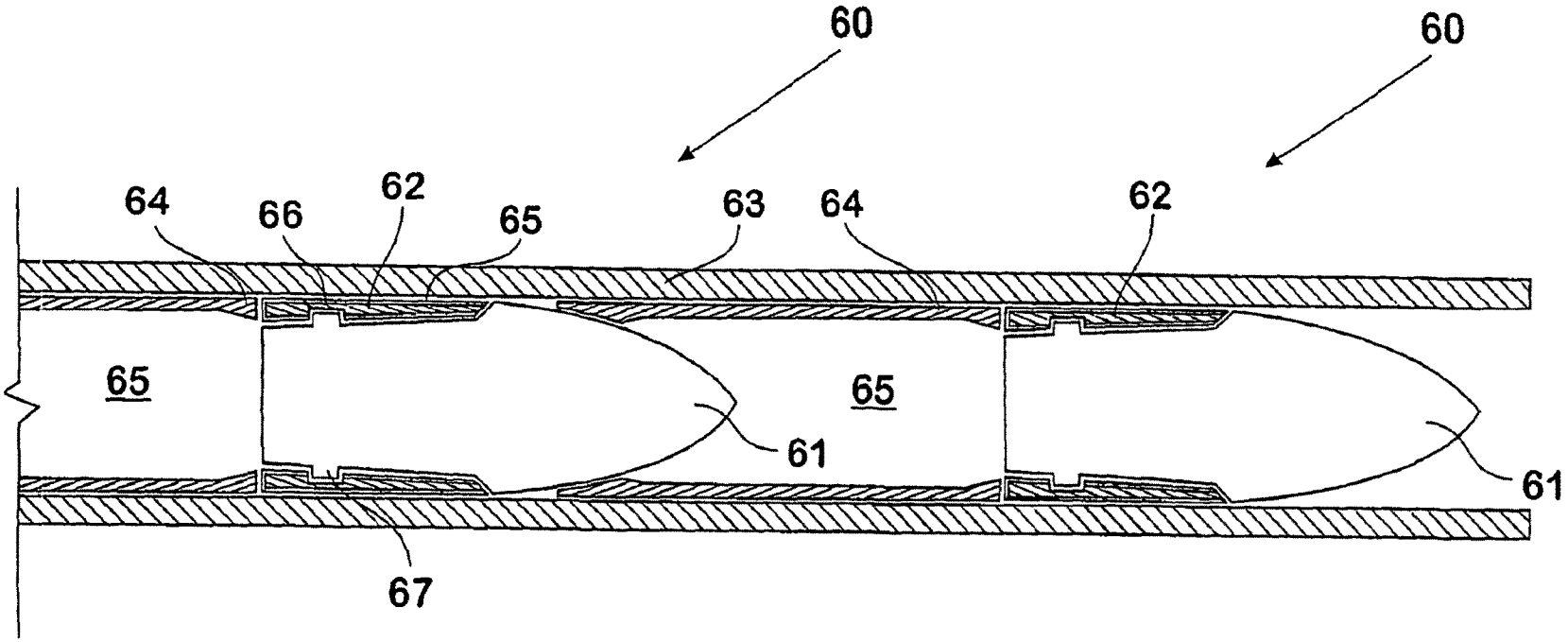
FIGS. 6 to 9 illustrate large bore rounds, suitably for barrels in the 100 to 200 caliber range.
Figure 7:
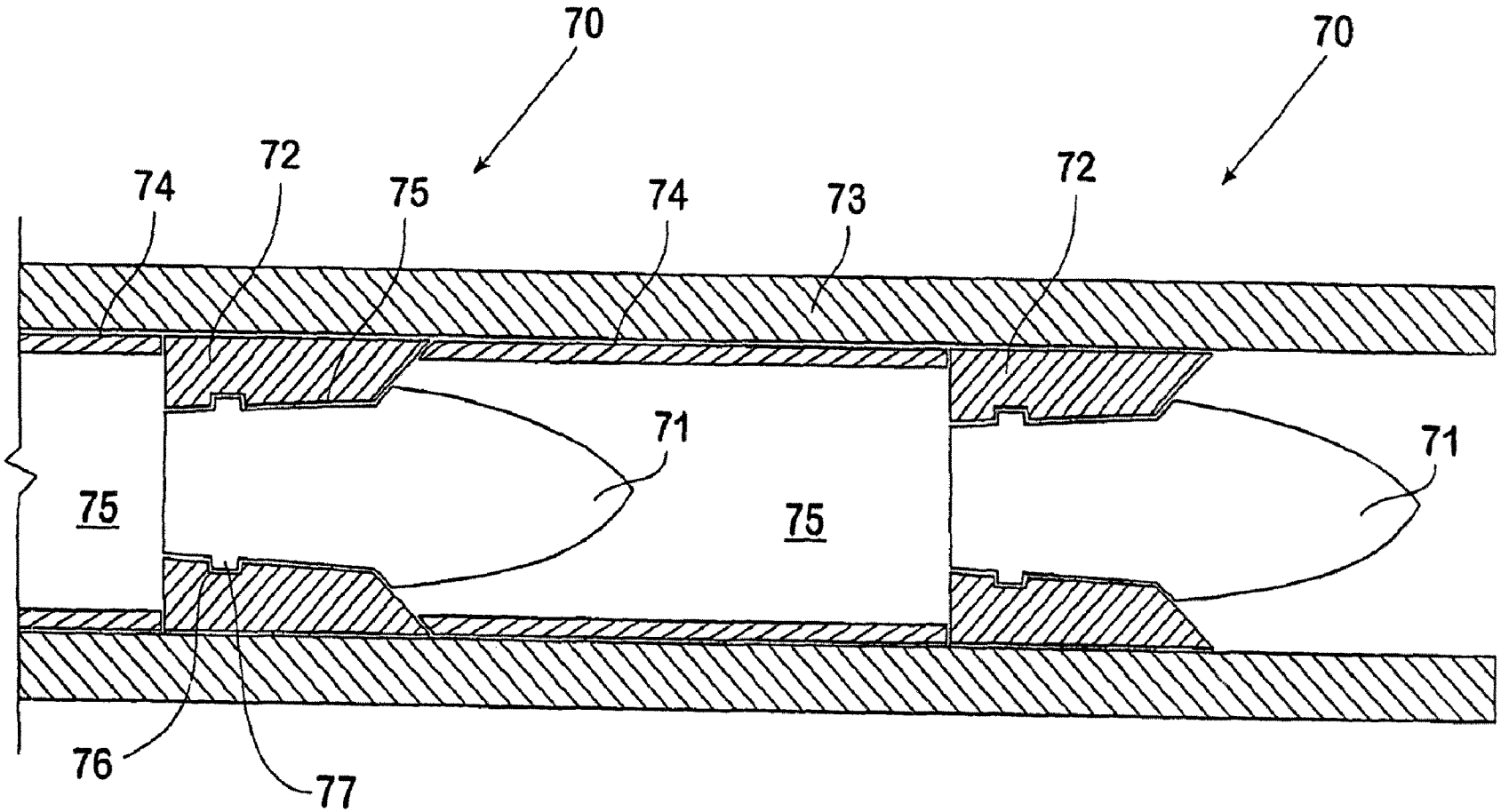
Figure 10:
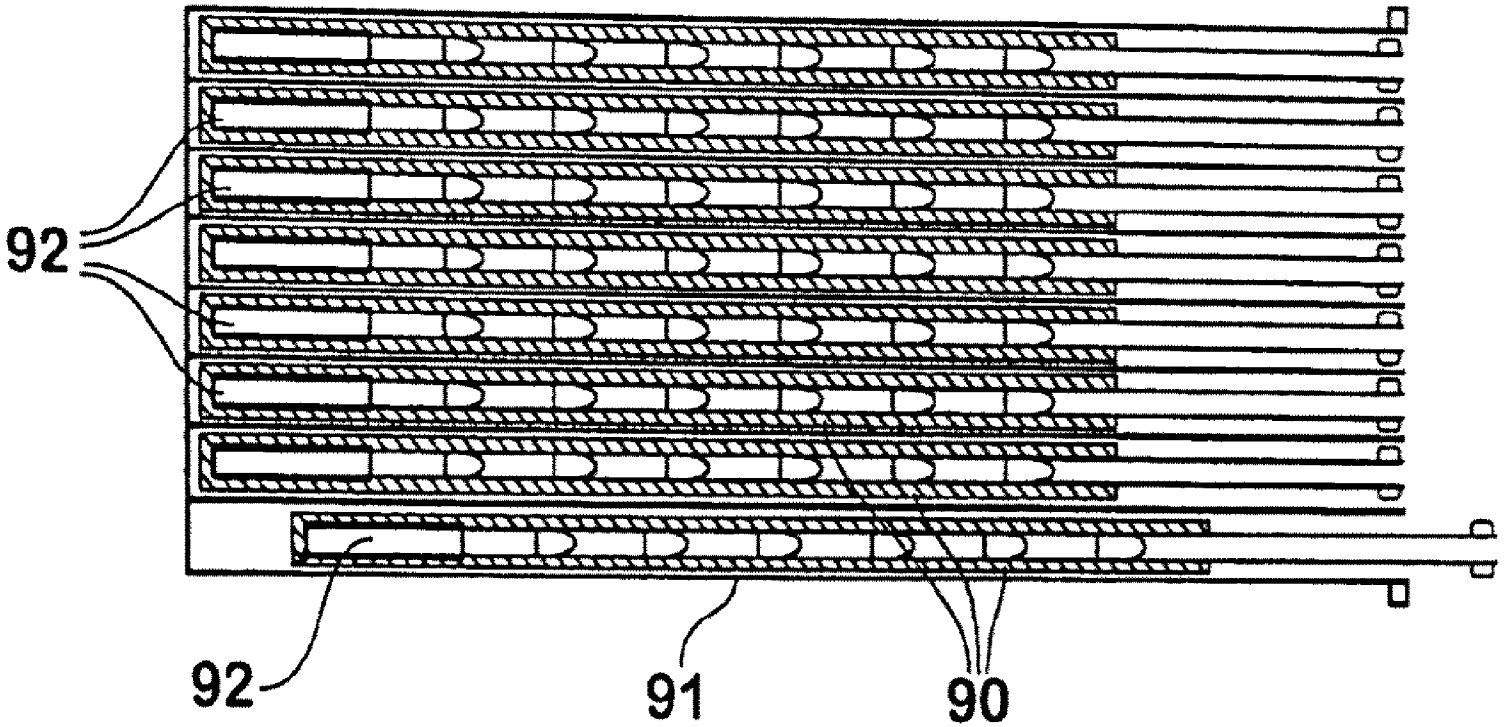
FIG. 10 illustrates a multi-barrel weapon for the projectiles illustrated in FIGS. 6 to 8.

The large bore rounds 60, 70 illustrated in FIGS. 6 and 7 each have a large heavy projectile 61, 71 such as 155 mm diameter projectiles which may include high explosives provided with an outer sealing part 62, 72 engaged in a barrel 63, 73 and surrounding a trailing portion of the projectile and engaged therewith in a wedging manner whereby rearward of the projectile relative to the sealing part will expanded the sealing part into sealing engagement with the bore of the barrel in which they are-seated, such as the barrels 100 illustrated in FIG. 10.

For this purpose each sealing part is supported fixedly in its barrel 63, 73 as part of a rigid column composed of stacked sealing parts 62, 72 and alternate combustible structural tubes 64, 74 containing the propellant 65, 75.

The sealing parts 62, 72 have inner frusto-conical surfaces 65, 75 interrupted by an annular recess 66, 76 which fits loosely over an outwardly extending band 67, 77 encircling the complementary outer frusto-conical surface 68, 78 of the projectile 61. This band 67, 77 maintains engagement of the sealing part 62, 72 on the projectile during flight and handling.

Figure 8:
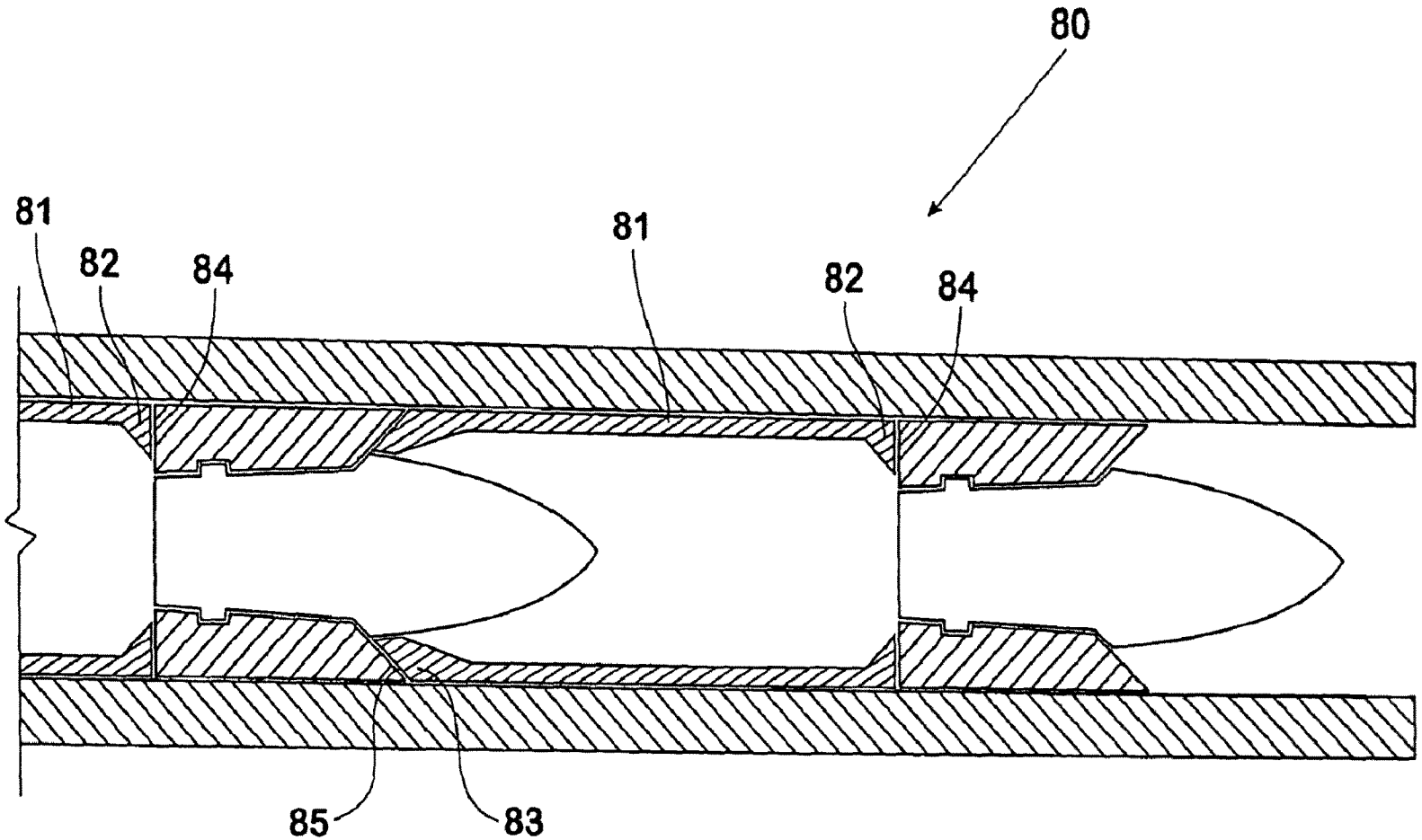

FIG. 8 illustrates a further projectile 80 similar to the FIG. 7 embodiment but wherein the spacer tubes 81 have enlarged end portions 82, 83 to provide larger mating load transferring faces 84, 85.

Figure 9:
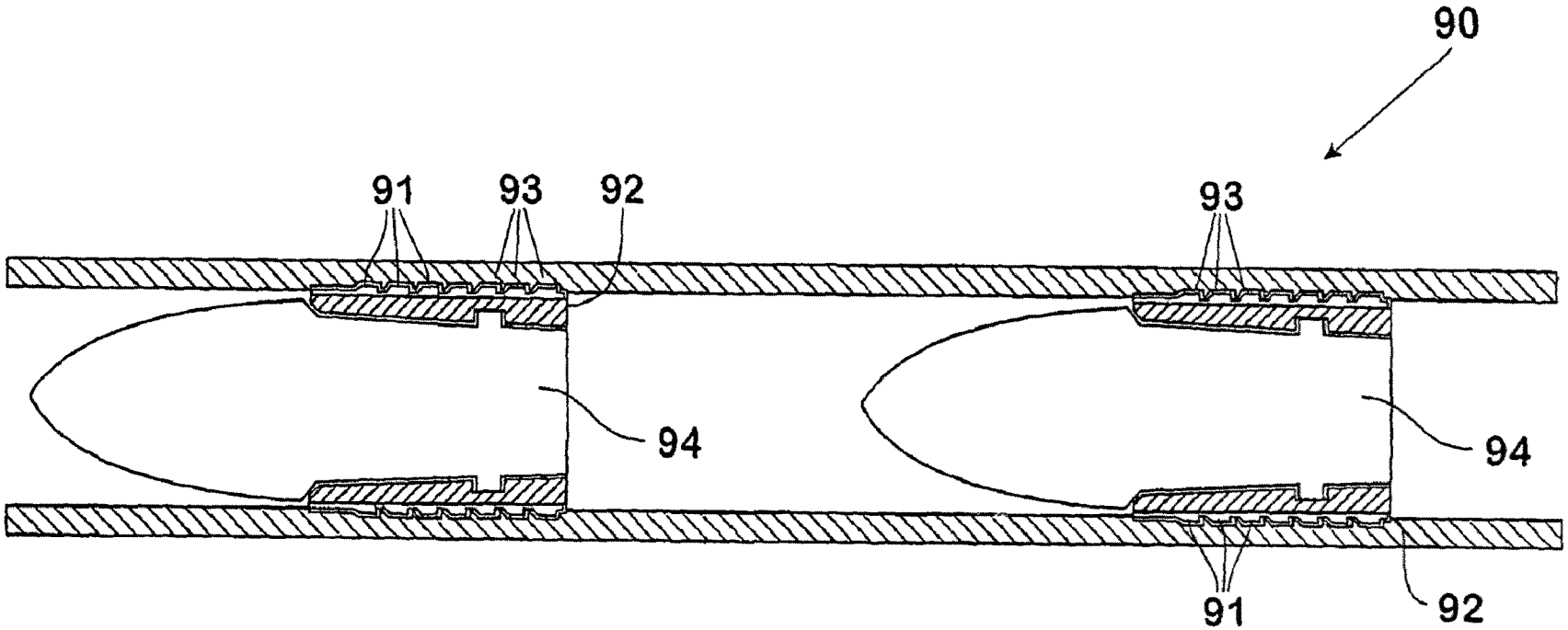

The projectile assembly 90 illustrated in FIG. 9 utilizes a series of circumferentially extending ripples 91 formed on the sealing means 92 which mate with complementary grooves 93 in the barrel to maintain the projectile 94 in spaced apart relationship in the barrel and to hold the sealing means 92 against rearward movement in lieu of the combustible structural tubes such that the sealing means 92 may be expanded outwardly by rearward movement of the projectile 94 to seal against propellant gases from a leading round traveling rearward to the following propellant charge. If desired, the ripples may be formed as a spiral thread so as to assist in sealing engagement with and location in a barrel.

As illustrated in FIG. 10 the projectile assemblies 60, 70, 80 and 90 may be accommodated in replaceable barrels 90 supported vertically in a pod 91. The barrels may be cushioned by recoil control means 92 and they may be adapted to be extended slightly from the pod prior to firing.

It will of course be realized that the above has been given only by way of illustrative example of the invention and that all such modifications and variations thereto as would be apparent to persons skilled in the art are deemed to fall within the broad scope and ambit of the invention as is herein set forth.

What is claimed is:

1. A projectile for use with barrel assemblies having a plurality of projectiles axially disposed within a barrel having a bore and a muzzle, the projectiles being associated with discrete propellant charges for propelling said projectiles sequentially through the muzzle of the barrel, the projectile comprising:

a sleeve for engagement with the bore of the barrel; and a projectile core about which the sleeve is disposed, wherein the sleeve surrounds and engages with a trailing portion of the projectile core;

a spacer tube extending rearwardly from the sleeve for extending over a portion of a trailing projectile, the spacer tube abutting a sleeve of the trailing projectile to form a column of sleeves and spacer tubes of said projectiles, the spacer tube having an end portion with a load transferring face for operatively transferring a load applied to the spacer tube to the abutting sleeve of the trailing projectile; and a discrete propellant charge contained in the spacer tube to facilitate propelling of the projectile core and sleeve from the barrel, wherein the sleeve is retained about the projectile core and the spacer tube is carried away with the projectile when the projectile is propelled from the barrel.

2. A projectile according to claim 1 wherein the sleeve and projectile core have cooperating surfaces operable against each other to expand the sleeve into a sealing engagement with the bore of the barrel in response to a relative axial pressure exerted upon the sleeve by the projectile.

3. A projectile according to claim 2 wherein the cooperating surfaces are in a form of complementary wedging surfaces.

4. A projectile according to claim 2 wherein the projectile core comprises a mandrel portion which cooperates with a deformable annular sleeve.

5. A projectile according to claim 2 wherein the projectile core includes a rearwardly tapering wedging surface and the sleeve includes a complementary surface which assists the sleeve to expand as the projectile core moves rearwardly in the barrel relative to the sleeve.

6. A projectile according to claim 1 wherein the sleeve is retained about the projectile core by at least one shoulder located on one of the sleeve and the core, and wherein the shoulder is engaged with a corresponding recess on one of the core and the sleeve.

7. A projectile according to claim 1 wherein the cooperating surfaces are disposed on an end portion of the spacer tube and a leading face of the sleeve respectively, wherein the sleeve of the trailing projectile is urged into engagement with the bore of the barrel in response to relative axial compression between the spacer tube and the sleeve of the trailing projectile.

8. A projectile according to claim 1 wherein the sleeve is formed as a discarding sabot about the projectile core and is configured to discard upon impact with a target.

9. A projectile according to claim 1 wherein the sleeve is formed as a discarding sabot about the projectile core and is configured to discard in flight once the projectile core and sleeve have been propelled from the barrel.

10. A barrel assembly having a plurality of projectiles axially disposed within a barrel having a bore and a muzzle, the projectiles being associated with discrete propellant charges for propelling said projectiles sequentially and selectively through the muzzle of the barrel, each projectile comprising:

a sleeve for engagement with the bore of the barrel; and a projectile core about which the sleeve is disposed, wherein the sleeve surrounds and engages with a trailing portion of the projectile core;

a spacer tube extending rearwardly from the sleeve for extending over a front portion of a trailing projectile core, the spacer tube abutting a sleeve of the trailing projectile to form a column of sleeves and spacer tubes of said projectiles, the spacer tube having an end portion with a load transferring face for operatively transferring a load applied to the spacer tube to the abutting sleeve of the trailing projectile; and a discrete propellant charge contained in the spacer tube to facilitate propelling of the projectile core and sleeve from the barrel, wherein the sleeve is retained about the projectile core and the spacer tube is carried away with the projectile when the projectile is propelled from the barrel.

11. A projectile according to claim 7 wherein the cooperating surfaces comprise tapering wedging surfaces.

12. A projectile according to claim 11 wherein the tapering surfaces comprise rearwardly tapering surfaces.

13. A projectile according to claim 1 wherein the propellant charge is an encased propellant charge including a primer.

14. A projectile according to claim 1 wherein the propellant charge includes an electric primer.

15. A barrel assembly according to claim 10 wherein the barrel comprises a non metallic disposable barrel.

16. A barrel assembly according to claim 10 wherein the sleeve is retained about the projectile core by at least one shoulder located on one of the sleeve and the core, and wherein the shoulder is engaged with a corresponding recess on one of the core or the sleeve.

17. A barrel assembly according to claim 10 wherein cooperating surfaces are disposed on an end portion of the spacer tube and a leading face of the sleeve respectively, wherein the sleeve of the trailing projectile is urged into engagement with the bore of the barrel in response to relative axial compression between the spacer tube and the sleeve of the trailing projectile.

18. A barrel assembly according to claim 17 wherein the cooperating surfaces comprise rearwardly tapering wedging surfaces.

19. A barrel assembly according to claim 10 wherein the propellant charge is an encased propellant charge including a primer.

20. A barrel assembly according to claim 10 wherein the propellant charge includes an electric primer.

* * * * *